US005730054A

United States Patent [19]

Liu

[11] Patent Number: 5,730,054

[45] Date of Patent: Mar. 24, 1998

[54] MECHANISM FOR A COLORING AND INKING DEVICE OF A PRINTER

[76] Inventor: Hsing-Jen Liu, No. 10, Alley 33, Lane 422, Min-Tsu Road, Lu-Chou Shiang, Taiwan

[21] Appl. No.: 798,601

[22] Filed: Feb. 11, 1997

[51] Int. Cl.[6] ..... B41F 3/00

[52] U.S. Cl. ..... 101/212; 101/358

[58] Field of Search ..... 101/212, 214, 101/250–252, 282–285, 353, 356–358, 55, 56, 133, 134, 146, 158, 161, 173, 186, 187, 189, 191, 192, 269

[56] References Cited

U.S. PATENT DOCUMENTS 1,447,333 3/1923 Bacon ..... 101/212

2,017,010 10/1935 Meisel et al. ..... 101/212

*Primary Examiner*—J. Reed Fisher

*Attorney, Agent, or Firm*—Bacon & Thomas

[57] ABSTRACT

An inking and coloring device for a printer has a pair of ink supply rollers, a pair of ink transfer rollers, a printing drum, a cam arm and a drive device. Each of the ink transfer rollers are movable between a first position in which the ink transfer rollers contact a respective ink supply roller and a second position for transferring ink to the printing drum. Each of the ink transfer rollers are connected to a respective cam roller operable by the cam arm. The drive device causes the cam arm to move in a reciprocal manner, thereby causing each cam roller to move a respective ink transfer roller between its first and second positions. The arrangement is such that when one ink transfer roller is in the first position, the other is in the second position and, vice versa. The printing drum is reciprocally movable between the ink transfer rollers simultaneously with the movement of the said cam arm.

2 Claims, 4 Drawing Sheets

MECHANISM FOR A COLORING AND INKING DEVICE OF A PRINTER

BACKGROUND OF THE INVENTION

1. Field of the Invention

The present invention relates to an improved mechanism of a coloring and inking device of printer by driving of the crank shaft to cause accustomed cam driving to be converted into straight reciprocating motion in order to reduce the complexity of the design of the printer and the difficulty in maintenance as well as increase the efficiency of the work of printing.

2. Description of the Prior Art

The coloring and inking device of conventional primer is shown as in FIG. 1, in which, the motive force comes from the conveying of the gear 1' to drive the gears 2', 3'. The gears 2', 3' have larger thickness with the can paths 21', 31' to be milled on the internal surface, and the rollers 43', 53' matching up the cam paths 21', 31' are driven to push the crank shafts 42'. 52' simultaneously. The crank shafts 41', 51', 52' are locked on the shafts 4', 5' with pins, the conveying of the motive force resulting in the connecting shafts 44', 54' to pull the crank shafts 61', 71' to become an arc shape up and down motion; the crank shafts 61', 71' are fixed on the shafts 6', 7' respectively, and there are color rollers 62', 72' on the former ends of the crank shafts 61', 71'. The horizontal path on the bottom end is the printing bed 10' on which a plate cylinder 13' performs reciprocating motion. In the reciprocating motion, the gear 12' locking up with the plate cylinder 13' is driven by another mechanism to cause it to move on the gear 11'.

Please refer to FIG. 1 again, as the crank shaft 61' is on the bottom dead point A and the crank shaft 71' is on the top dead point B', and the plate cylinder 13' is on the right extreme point C, while the new printing cycle starts, the steel inking roller 8' completed the applying of printing ink on the color roller 62' and the crank shaft 71' of the color roller 72' which has completed the last cycle of priming is pulled by the connecting shaft 54' allowing it to contact with the steel ink roller 9' to be inked and prepare to operate anew; on this time the plate cylinder 13' goes form the fight extreme point C towards point E by means of straight rolling, in the meantime the action of the cam pate 21" which draws the color roller 62' to move upward matches up with the advancing of the plate cylinder 13', in such circumstances the pattern plate on the plate cylinder 13' (the printing plate providing on the arc FG) contact the printing bed 10', and print the pattern on the paper on it; the course of the moving of the plate cylinder 13' up to the left extreme point D is exactly the course of the crank shaft 71' to apply the printing ink provided by steel ink roller 9' on the plate cylinder 13' the ink on which has been exhausted. While the plate cylinder 13' reaches the left extreme point D, the action to return is exactly the same as that of the above action in reverse direction; accordingly, twice printing of the surface of plate are completed in one stroke.

However, there are the following disadvantages on the using of the above conventional device:

(1) The action of coloring and inking is driven by the cam paths 21', 31', what is worthy to note first is that the design of the cam driving mechanism is to convert the original straight and curve motion into circular motion, it requires not only accurate coordination, but also the calculation and test of the shape of the cam and error might be accumulated, the mechanism is complex and difficult for maintenance, and the cost of design is high.

(2) The coloring and inking device of the above printer requires to be adjusted and positioned frequently. In order to meet the requirement of different operation, on adjusting the cam driving mechanism, it is required to coordinate the axle centers of the shafts 4', 5' and gears 2', 3'. In addition, once the accumulated error of the cam in above item (1) is so big as to cause the rollers 43', 53' not to move up and down as seen in FIG. 1, deformation would occur due to the scratching and squeezing on the contacting surfaces of the cam paths 21', 31' of the rollers 43', 53' which are restricted to move; consequently, the time of the maintenance and repairment of the printer will be increased and the life of use of the printer will be shortened.

In view of the above described disadvantages possessed by the conventional coloring and inking device of printing machine, the present invention made extensive researches aiming to improve these disadvantages and resulted in completion of this invention.

SUMMARY OF THE INVENTION

An object of the present invention in the improvement of the coloring and inking device of the printer is to utilize the straight driving via crank shaft conveying to provide a mechanism which is convenient in assembling and less required in maintenance, the action in the stroke of the mechanism is simplified, the design is easy and the regulation is convenient.

Another object of the present invention in the improvement of the coloring and inking device of the printer is to utilize the method of path conveying by straight driving to provide a mechanism which allows the room for buffering; it is sufficient to prevent the scratching, squeezing and wearing to be caused by excessive limit of action in order to reduce the requirement of maintenance and lengthen the life of the use of the machine.

BRIEF DESCRIPTION OF THE DRAWINGS

A more complete understanding of these and other features and advantages of the present invention will become apparent from a careful consideration of the following detailed description of certain embodiments illustrated in the accompanying drawings.

DETAILED DESCRIPTION OF THE PREFERRED EMBODIMENT

Figure 1:
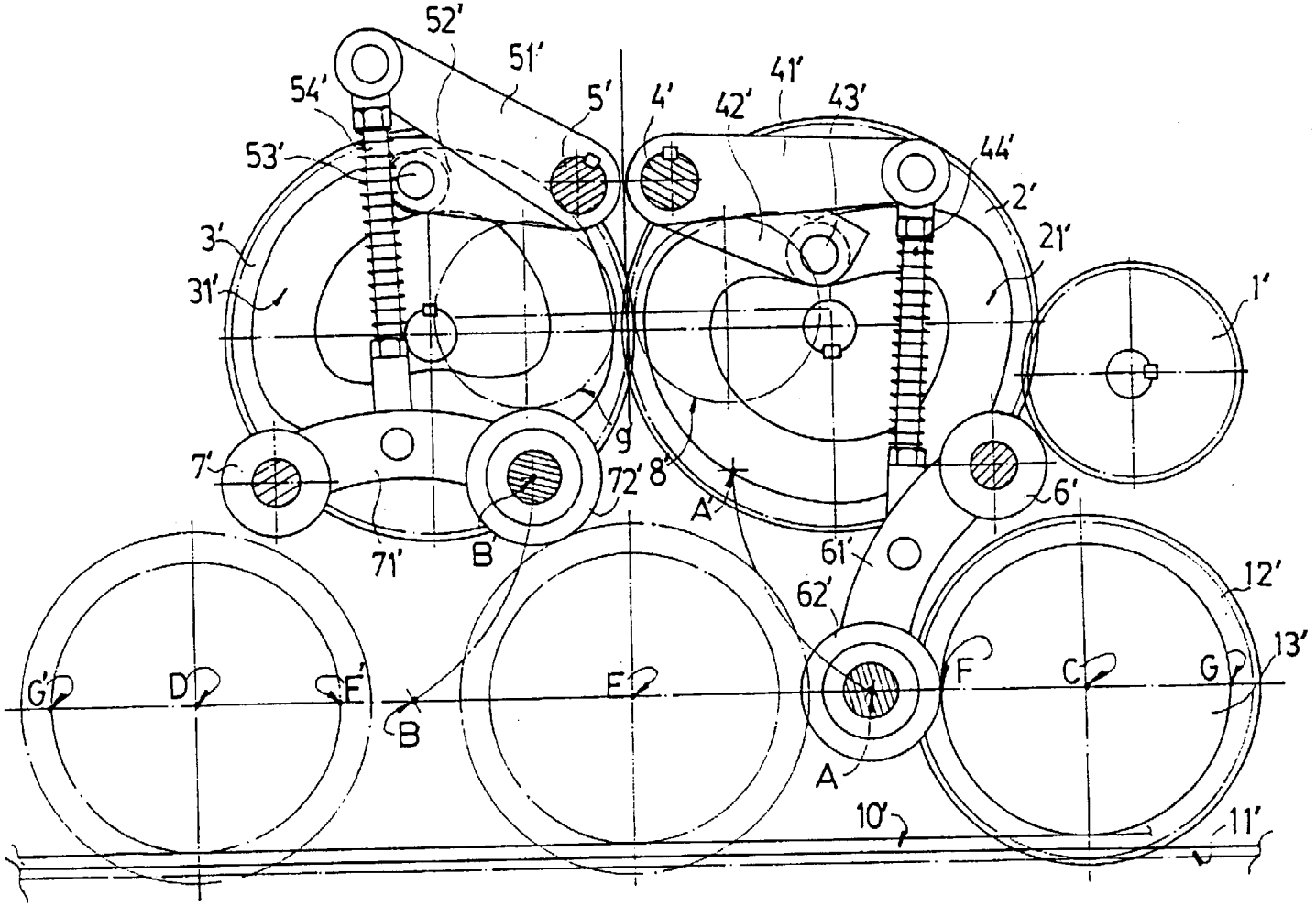
FIG. 1 (PRIOR ART)
FIG. 1 is the schematic drawing of the coloring and inking mechanism of accustomed printing press.
Figure 2A:
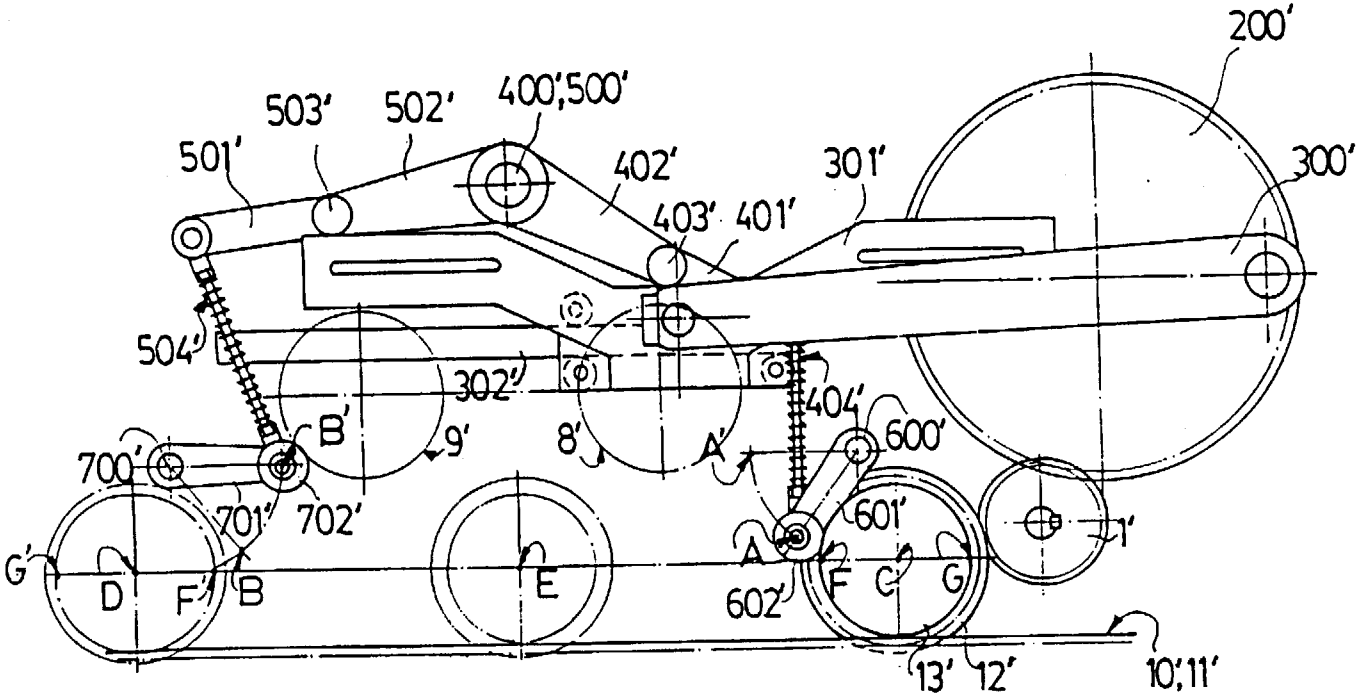
FIGS. 2A and 2B are the schematic drawings of the mechanism of the present invention.
Figure 2B:
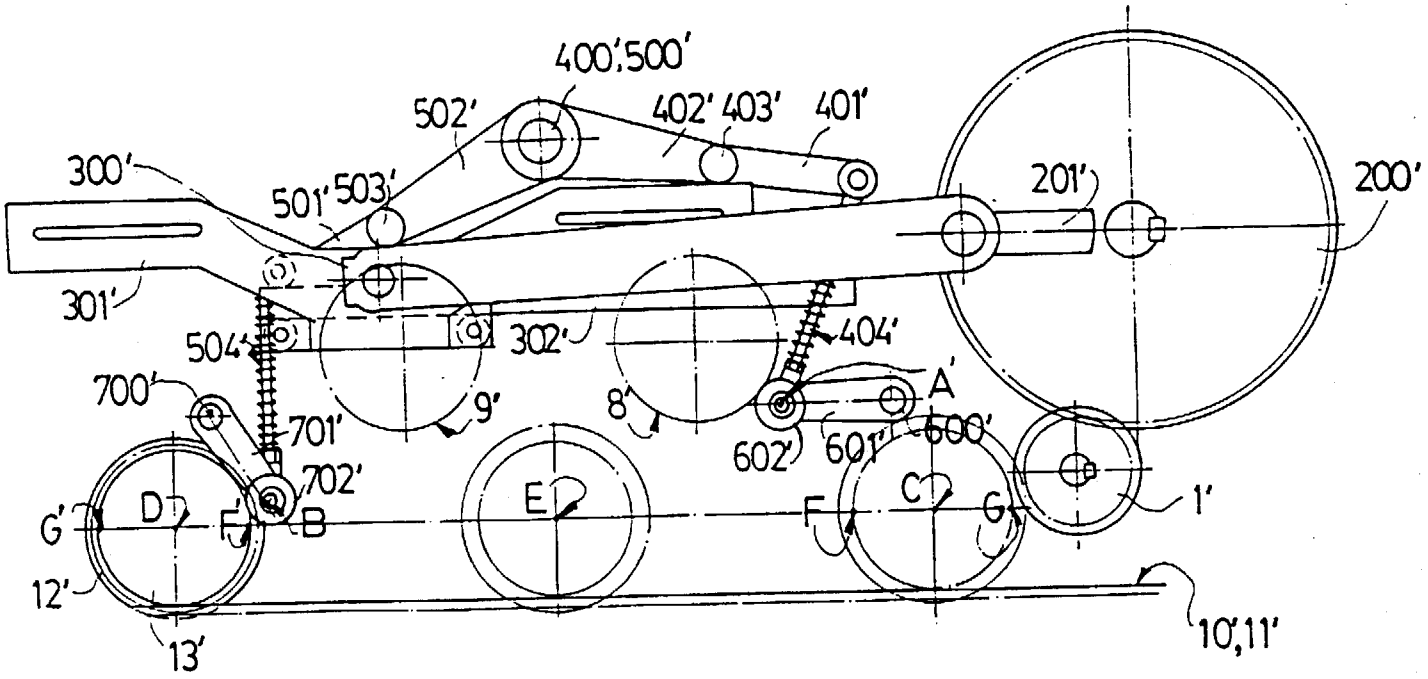

FIGS. 2A and 2B show the improvement of the coloring and inking device in the above printer in which the motive force is conveyed to the gear 1' by motor and then conveyed to the bull gear 200' which has a regulating groove 201' allowing the inserting and positioning of the crank shaft 300'; the crank shaft 300' is combined with the V shape sliding block 301' which is placed on the path 302'; there is a set of shafts 400', 500' fitted together on the top of the V shape sliding block 301' to move the cranks 402', 502' respectively. The toggle crank shaft 402', 502' are fitted into the axles 400', 500' which are allowed to turn freely; the other end of the toggle crank shafts 402', 502' are joined together with the crank shafts 401', 501' which provide roller 403', 503' in which the centers of axle of the rollers 403', 503' are soldered on the crank shafts 401', 501', and the other ends of the crank shafts 401', 501' are connected with inking connecting rods 404', 504'; the other ends of the inking connecting rods 404', 504' drive the coloring crank shafts 601', 701' to be fixed on the shafts 600', 700' and the color rollers 602', 702' are connected on the joint of the coloring crank shafts 601', 701' and the inking connecting shafts 404', 504'; besides, the plate cylinder 13' is arranged as in conventional printing press to drive the gears 12' on the two ends of the plate cylinder by another mechanism to perform reciprocating motion on the gear 11' allowing the plate cylinder to perform the function of printing on the printing bed 10'.

Figure 3:
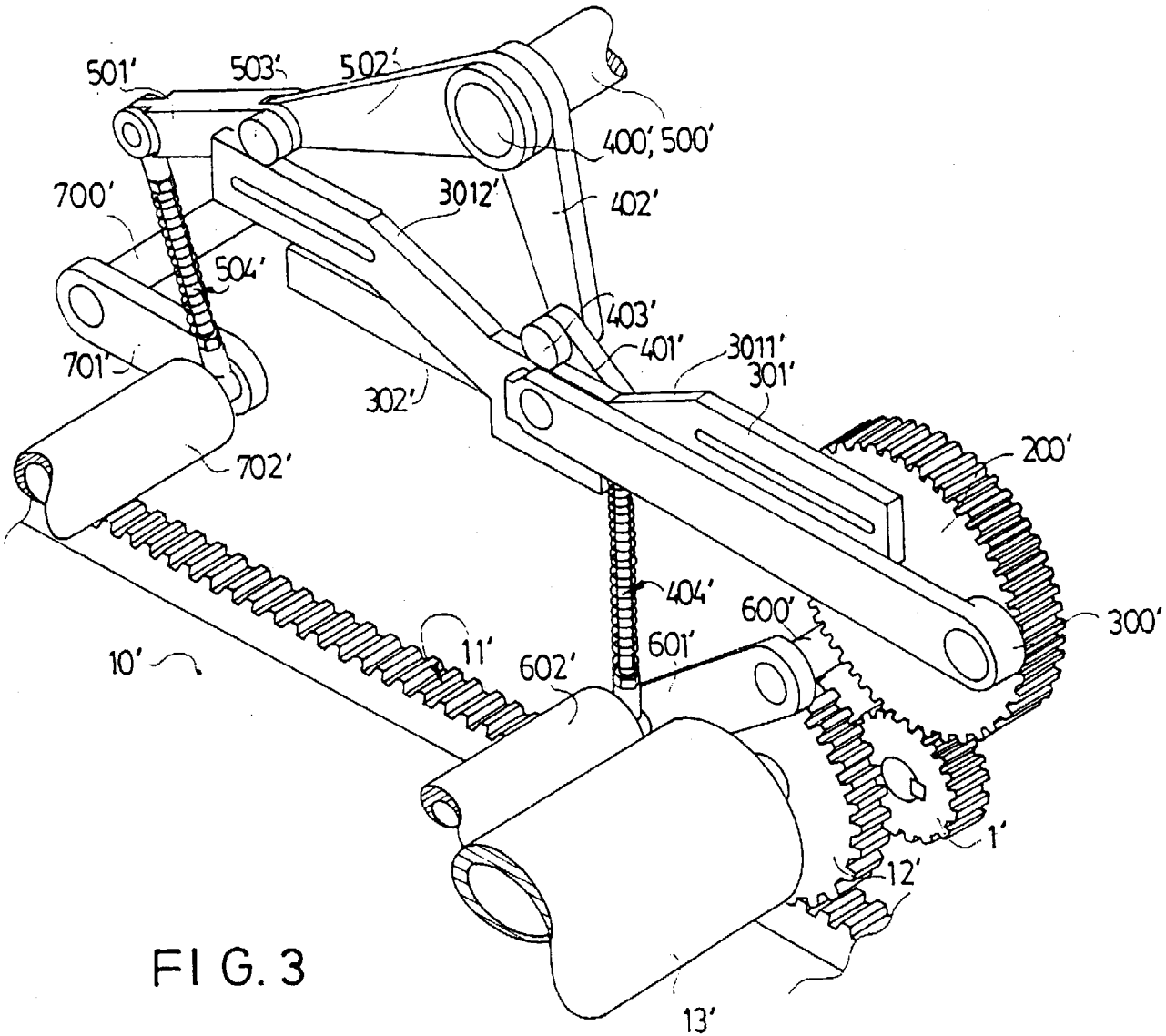
FIG. 3 is the drawing of the assembly of the present invention.

As for the way of motion and the embodiment of the present invention, please refer to FIGS. 2A, 2B and 3 for the understanding of the relative positions of the components and the path of motion.

After completing one stroke of the operation of printing before another cycle of the above mechanism of the present invention as shown in FIG. 2A, the color roller 602' which has been filled up with ink is located on the bottom dead point A, and the color roller 702' the ink of which has been exhausted is located on the top dead point B' to contact with the steel ink cylinder 9' to fill in ink; with the plate cylinder 13' moving from the right extreme point D towards the central point E, the crank shaft 300' pushes the sliding block 301' leftwards in which the inclined plane 3011' of the sliding block 301' pushes exactly the roller 403' upwards gradually, in the meantime the inking connecting rod 404' moved by the crank shaft 401' pulls the color roller 602' upwards gradually to proceed the operation of inking and printing; while the plate cylinder 13' passed the central point E and the roller 403' slides to the right plane of the V shape sliding block 301', the color roller 602' the ink of which has been exhausted contact exactly the steel inking cylinder 8' to receive the feeding of ink; meanwhile the roller 503' drops from the left inclined plane 3012' of the sliding block 301' to cause the color roller 702' which is filled up with ink to drop to the bottom dead point B. As shown in FIG. 11B, while the plate cylinder 13' is on the left extreme point D to start to return to the right extreme point C, the procedure and the way of motion remain the same as those to be described in FIGS. 2A and 2B, the mechanism is also to facilitate the plate cylinder 13' to perform twice operation of printing in one reciprocating stroke.

FIG. 3 is a drawing of the assembly of the present invention, it shows the related positions of the components. On changing the operation of printing, the axles 400', 500' are allowed to move upwards and downwards to regulate the arcs A A', B B' of the top and bottom dead points of the color rollers 602' 702', and the regulating groove 201' allows the crank shaft 300' to regulate the length of the stroke of the pushing sliding block 301'. There are the following differences in comparing the present invention and conventional products.

(1) The accustomed way to drive the mechanism by cam is to guide the roller by way of the path of the roller to limit the motion of the roller; but the shape of the path of the cam is not quite accurate, error might be incurred; once excessively accumulating of the error occurred, it will result in the shifting of the position of the roller, and the action of printing on both sides will not be uniform resulting in the roller to press the cam path to incur the wearing of the components out of scratching and squeezing. The mechanism of the present invention is to utilize the inclined plane and flat plane of the sliding block which is free of restriction; once an error occurred to cause the jumping of the roller, there is room for shifting to prevent it from the wearing due to scratching and squeezing; in other words, the present invention provides more secure operation for the components and lengthens the life of the machine.

(2) As stated above, the accustomed components will incur wearing due to scratching and squeezing resulted from error so that the user is required to regulate the position of the mechanism. In addition, as the path of the cam is fixed, it takes a lot of procedures to match up the roller with the path of the cam on regulating the axles. The same mechanism of the present invention is to regulate the positions of the crank shaft and the driving gear to change the stroke directly, and then regulate the coaxial crank shafts to complete the regulation of the top and bottom dead points of the color roller. It is easy for the user.

The above description and accompanying drawings are only used to illustrate a preferred embodiment of the present invention, not intended to limit the scope thereof. Many made without departing from the spirit of the present invention.

What is claimed is:

1. An inking and coloring device for a printer comprising: a pair of ink supply rollers, a pair of ink transfer rollers, a printing drum, a cam arm and a drive means; means for mounting said printing drum for reciprocal movement; means for moving each of the ink transfer rollers between a first position in which the ink transfer roller contacts a respective ink supply roller and a second position for transferring ink to the said printing drum, each of the ink transfer rollers being connected to a respective cam roller operable by the cam arm; said drive means connected to said cam arm so as to move said cam arm in a reciprocal manner, thereby causing each of said cam rollers to move a respective ink transfer roller between its first and second positions, such that when one ink transfer roller is in the first position, the other is in the second position, and vice versa; and, means for reciprocally moving said printing drum being between the said ink transfer rollers simultaneously with the movement of the said cam arm.

2. An improved mechanism for a coloring and inking device of a printer, comprising:

a crank shaft driving set;

a sliding block having a generally v-shaped guide surface thereon and connected to the crank shaft driving set;

one set of pivoting toggle crank shafts, each having a roller bearing against the guide surface of the sliding block;

a coloring connecting rod connected to each toggle crank shafts;

a color roller connected to each of the coloring connecting rods;

a motor connected to the crank shaft driving set;

a plate cylinder;

a support for supporting a paper substrate below the plate cylinder so as to print a pattern thereon; and, a drive system for reciprocating the plate cylinder along a linear path, whereby;

the crank shaft driving set converts the motive force from the motor into straight reciprocating motion with a predetermined stroke to drive the sliding block, inclined planes of the V-shape of the sliding block guide surface causes the rollers connected to the toggle crank shafts to move upwards and downwards thereby moving the coloring connecting rods, which movement causes the color rollers to move upwards and downwards in an arcuate path to facilitate the application of ink to the plate cylinder for the printing of patterns on the paper substrate.

* * * * *